United States Patent [19]

Dickinson et al.

[11] Patent Number: 4,740,293

[45] Date of Patent: Apr. 26, 1988

[54] PREMIUM COKE FROM A BLEND OF PYROLYSIS TAR AND HYDROTREATED DECANT OIL

[75] Inventors: Eric M. Dickinson, Bay Village; Arthur W. Moore, North Olmsted, both of Ohio

[73] Assignee: Union Carbide Corporation, Danbury, Conn.

[21] Appl. No.: 696,417

[22] Filed: Jan. 30, 1985

Related U.S. Application Data

[63] Continuation of Ser. No. 627,543, Jul. 3, 1984, abandoned, which is a continuation-in-part of Ser. No. 540,943, Oct. 11, 1983, abandoned, which is a continuation-in-part of Ser. No. 335,520, Dec. 29, 1981, abandoned.

[51] Int. Cl.[4] ..... C10G 9/14; C10B 57/02

[52] U.S. Cl. ..... 208/131

[58] Field of Search ..... 208/131, 50

[56] References Cited

U.S. PATENT DOCUMENTS

| | | | |
|---|---|---|---|
| 2,922,755 | 1/1960 | Hackley, Jr. | 208/131 |
| 3,326,796 | 6/1967 | Muller | 208/50 |
| 3,451,921 | 6/1969 | Janes | 208/50 |
| 3,704,224 | 11/1972 | Scovill et al. | 208/131 |
| 3,817,853 | 6/1974 | Folkins | 208/131 |
| 4,049,538 | 9/1977 | Hayash et al. | 208/131 |
| 4,066,532 | 1/1978 | Garcia | 208/131 |
| 4,075,084 | 2/1978 | Skripek et al. | 208/131 |
| 4,213,846 | 7/1980 | Sooter et al. | 208/50 |

*Primary Examiner*—Andrew Metz
*Assistant Examiner*—Glenn Caldarola
*Attorney, Agent, or Firm*—C. F. O'Brien

[57] ABSTRACT

A premium coke is made by the delayed coking of a blend of pyrolysis tar and hydrotreated decant oil.

2 Claims, 7 Drawing Sheets

PREMIUM COKE FROM A BLEND OF PYROLYSIS TAR AND HYDROTREATED DECANT OIL

This application is a continuation of prior U.S. application Ser. No. 627,543 filed 7/3/84 and which is a continuation of application Ser. No. 540,943, filed 10/11/83 and which is a continuation in part of application Ser. No. 335,520 filed 12/29/81 all abandoned.

The invention relates to premium coke suitable for use in the production of a graphite electrode, and particularly to a process for producing a premium coke from a blend of pyrolysis tar and hydrotreated decant oil.

Premium coke is well kown in the art and is a commercial grade of coke having acicular, anisotropic microstructure.

The premium cokes are used in the production of electrode grade graphite. This use of premium cokes results in various requirements to be made of the cokes. Some of these requirements are pointed out herein.

A graphite electrode which will be used in the arc melting of steel or the like must possess a low value for the coefficient of thermal expansion (CTE) because of the severe thermal shocks which occur in such processes. The premium coke used for producing the graphite electrode must be capable of imparting a low CTE to the electrode.

The process for producing a graphite electrode from a premium coke requires that the electrode be heated to a temperature in the range of from about 2000° C. to about 3000° C. in order to provide energy to convert the carbon in the coke to a graphite crystalline form and to volatilize impurities. When a carbon body made from premium coke is heated to a temperature in the range of from about 1000° C. to about 2000° C., various sulfur-containing compounds present in the coke decompose and this could result in a rapid, irreversible expansion of the carbon body. This phenomenon is termed "puffing". It is desirable to use a low sulfur containing precursor material for producing the premium coke in order to minimize or preferably eliminate problems due to "puffing".

Typically, commercially produced premium cokes are made from low sulfur containing, aromatic, slowly reacting feedstocks such as decant oils from catalytic cracking and tars obtained from the thermal cracking of decant oils and gas oils.

It would be desirable to use pyrolysis tars as feedstocks for producing premium cokes because pyrolysis tars are relatively inexpensive mixtures of aromatic compounds and have low amounts of sulfur. Generally, pyrolysis tars are heavy by-products of the cracking process for producing ethylene.

Pyrolysis tars are known to be unsuitable for the commercial production of premium coke because this production is carried out by the delayed coking process and the highly reactive pyrolysis tars convert to coke in the coils of the delayed coker furnace. This results in clogging and short operating periods.

Another drawback of the pyrolysis tars is that the previous cokes produced from them impart an undesirably large CTE to the graphite electrodes.

Prior art attempts to produce a premium coke from pyrolysis tars have the drawbacks of poor economy and/or relatively high values of the CTE.

U.S. Pat. No. 3,817,853 hydrotreats a pyrolysis tar in the presence of an inert diluent and obtains a feedstock which produces graphite electrodes having a CTE of about $1.6\times10^{-6}$ per °C. and higher. While this is an improvement, a CTE of about $0.5\times10^{-6}$ per °C. or less is needed for high quality graphite electrodes. In addition, the examples in the patent teach the use of from about 12.2 to about 18.7 standard cubic meters of hydrogen per barrel of pyrolysis tar. This is a relatively high cost process.

U.S. Pat. No. 4,213,846 hydrotreats pyrolysis tars, petroleum resids, and thermal tars by coking them with a hydrogen donor diluent produced by the catalytic hydrotreatment of a coker gas oil fraction generated from the delayed coking of the blend. The hydrotreated feed is an equal blend with fresh feed. This process has several drawbacks. The hydrotreated coker gas oil does not contribute to the yield of the process and the examples teach a maximum of 15% by weight pyrolysis tars.

The instant invention overcomes the drawbacks of the prior art and provides a process for the commercial production of a premium coke suitable for making high quality graphite electrodes.

In its broadest embodiment, the invention is a process for producing a premium coke for making a graphite electrode having a CTE less than about $0.5\times10^{-6}$ per °C. comprising the steps of forming a blend of a pyrolysis tar and a hydrotreated decant oil which includes from about 50% to about 75% by weight of the pyrolysis tar and from about 50% to about 25% by weight of the hydrotreated decant oil; and coking the blend by delaying coking, whereby the premium coke is formed.

In a preferred embodiment, the hydrotreated decant oil is produced by hydrotreating a decant oil until there is added from about 2 to about 4 hydrogen atoms per average molecule of the decant oil, more preferably from about 2 to about 3 hydrogen atoms.

Another preferred embodiment of the invention is a graphite electrode made from the premium coke of the invention.

Further embodiments and advantages of the invention will be set forth in the following specification and will be obvious therefrom.

A pyrolysis tar as used herein and according to the prior art is generally the heaviest by-product of olefins production by vapor-phase cracking of liquid hydrocarbons in the presence of steam at temperatures of from about 760° C. to about 930° C. at pressures from about 100 kPa to about 200 kPa (15–30 psia). It is the fraction which boils above about 200° C.

A decant oil as used herein and according to the prior art is generally the highest boiling by-product of gasoline production by catalytic cracking after the removal of catalyst particles by settling. It generally boils at a temperature above about 300° C.

Preferably, the pyrolysis tar used in the invention should have a sulfur content of less than about 1% by weight and the decant oil used in the invention should have a sulfur content of less than about 2% by weight. The hydrotreatment of the decant oil provides the additional incidental advantage of hydrodesulfurizing the decant oil so that the potential problem of puffing is reduced or eliminated even though the hydrotreatment is not carried out for that purpose.

Generally the hydrotreatment of the decant oil can be carried out in accordance with the prior art by contacting the decant oil with hydrogen at an elevated temperature and high pressure in the presence of a suitable catalyst.

For a fuller understanding of the nature and objects of the invention, reference should be made to the following detailed description, taken in connection with the accompanying drawings, in which.

FIGS. 5–9, inclusive, are graphs illustrating the results shown in Tables 9, 13, 16, 19, 21, respectively.

Illustrative, non-limiting examples of the practice of the invention are set out below. Numerous other examples can readily be evolved in the light of the guiding principles and teachings contained herein. The examples given herein are intended to illustrate the invention and not in any sense to limit the manner in which the invention can be practiced. The parts and percentages recited therein and all through this specification, unless provided otherwise, refer to parts by weight and percentages by weight.

EXAMPLE 1

A gas oil-based pyrolysis tar A having the properties shown in Table 1 was blended with a hydrotreated decant oil A, having the properties shown in Table 2. Three blends were prepared with the amounts of pyrolysis tar A being 25%, 50% and 75% by weight.

TABLE 1

| PYROLYSIS TAR A | |
|---|---|
| Specific Gravity, 60° F. | 1.1238 |
| Distillation | |
| IBP | 230° C. |
| 5% | 280° C. |
| 10% | 290° C. |
| 20% | 320° C. |
| 30% | 336° C. |
| 40% | 364° C. |
| 50% | 390° C. |
| 60% | 450° C. |
| 70% | |
| 80% | |
| 90% | |
| 95% | |
| EP | |
| % Recovery | 67.5 |
| Molecular weight | 319 |
| Carbon, wt. % | 91.7 |
| Hydrogen, wt. % | 6.78 |
| Nitrogen, wt. % | 0.21 |
| Ash, wt. % | 0.0018 |
| Metals, ppm | |
| Sulfur, wt. % | 1.20 |
| Modified Conradson Carbon, wt. % | 23.1 |
| Aromaticity, wt. % | |
| Proton NMR | 40.09 |
| $^{13}C$ NMR | 80.6 |
| Pour Point | 19° C. |
| Flash Point | 127° C. |
| Bromine No. | 15.44 |
| Viscosity, centistokes | |
| 38° C. (100° F.) | 4079 |
| 99° C. (210° F.) | 206 |
| TGA Pitch Fraction (550° C.±) | 29.6 wt. % |
| Toluene Insoluble, wt. % | 4.6 |
| Heptane Insoluble, wt. % | 21.1 |

TABLE 2

| HYDROTREATED DECANT OIL A | |
|---|---|
| Specific Gravity | 1.0187 |
| Distillation | |
| IBP | 229° C. |
| 5% | 290 |
| 10% | 318 |
| 20% | 346 |
| 30% | 363 |
| 40% | 377 |
| 50% | 389 |
| 60% | 404 |
| 70% | 424 |
| 80% | 449 |
| 90% | 502 |
| 95% | — |
| EP | |
| Recovery % | 90% |
| Molecular Weight | |
| Carbon, Wt. % | 90.59 |
| Hydrogen, wt. % | 9.29 |
| Nitrogen, wt. % | 0.13 |
| Sulfur, wt. % | 0.37 |
| Modified Conradson Carbon, wt. % | 2.63 |
| Aromaticity, | |
| Proton NMR | 20.5 |
| $^{13}C$ NMR | 57.6 |
| Pour Point | −13° C. |
| Flash Point (Open Cup) | 138° C. |
| Bromine No. | 6.47 |
| Viscosity, centistokes | |
| 38° C. (100° F.) | 69.42 |
| 99° C. (210° F.) | 5.65 |
| TGA Pitch Fraction (550° C.+) | 48.7 |
| Toluene Insoluble, wt. % | 0.20 |
| Heptane Insoluble, wt. % | 0.01 |
| Hydrogen atoms per average molecule | 3 |

Figure 1:
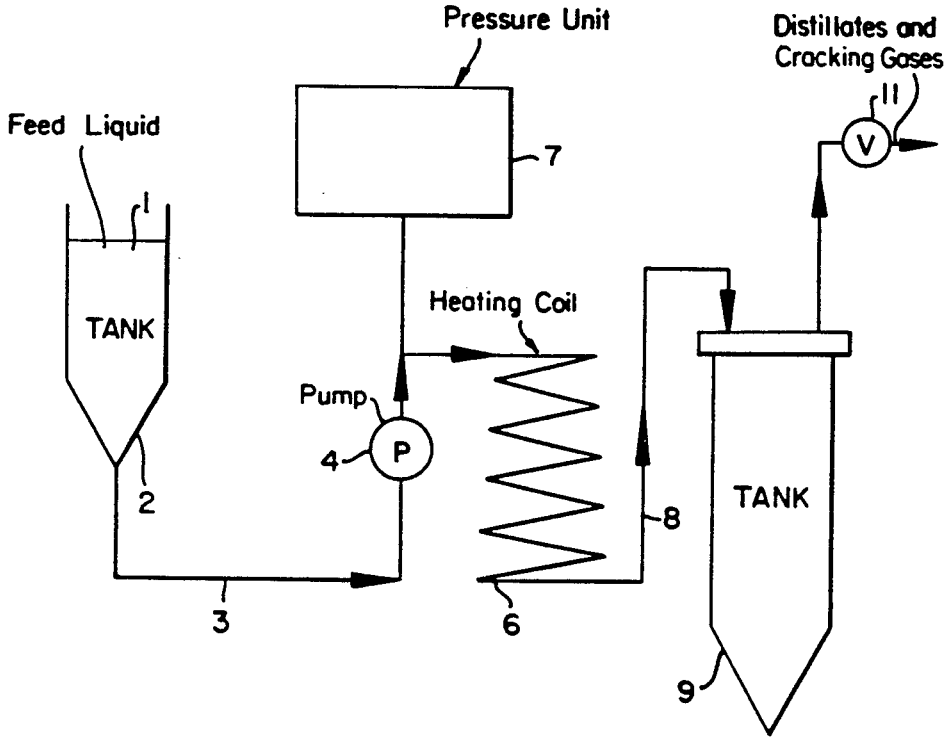
FIG. 1 is a simplified block system of a bench scale delayed coking unit used in a laboratory.

A bench scale delayed coking unit as shown in FIG. 1 was used to coke each of the blends as well as separate portions of the pyrolysis tar A and the hydrotreated decant oil A.

The coking unit of FIG. 1 operates as follows: A feed liquid 1 in tank 2 is pumped through line 3 by pump 4 at a rate of from about 17 to about 24 g. per minute. The feed liquid 1 in line 3 is conveyed to heated, pressurized coil 6 which maintains a high pressure due to pressure unit 7. The material in coil 6 communicates through line 8 to top of heated, pressurized tank 9. The temperature and pressure of coil 6 and tank 9 were about 475° C. and about 689 kPa. The feed period was from about 140 to about 170 minutes. After the feeding was completed, the coke was further devolatilized by heating at about 50° C. and holding this temperature for from about 75 to about 90 minutes. A pressure control valve 11 is provided for the removal of distillates and cracking gases.

For each blend, additional heating at about 1000° C. was carried out and the yields for these examples is shown in Table 3. The values shown in the Table 3 are based on measurements and deviate slightly from the sum of the components, being equal to 100%.

TABLE 3

Pyrolysis Tar A and Hydrotreated Decant Oil A
COKING YIELDS

| Wt. % Pyrolysis Tar A in Blend | Feed Rate g/min | Yields Wt. % 500° C. Coke | 1000° C. Coke | Distillate | Cracking Gas |
|---|---|---|---|---|---|
| 0 | 24 | 27 | 25.5 | 64.5 | 8.5 |
| 25 | 17 | 31.5 | 29.5 | 60 | 8.5 |
| 50 | 21 | 34 | 32 | 59 | 7 |
| 75 | 17 | 40 | 37.5 | 53 | 7 |
| 100 | 20 | 39 | 36 | 56 | 5 |

The Table 3 shows that the distillates and cracking gas yields reduced as the amount of pyrolysis tar increased.

The coke from each of the tests was used to produce graphite electrodes in accordance with conventional testing procedures. The procedure used is generally as follows:

The coke which had been calcined at 1000° C. was crushed and milled to 55%±10% through 200 mesh to obtain a flour. The flour was made into a rod about 130 mm long with a 19 mm diameter.

The rod was then converted into a graphite electrode. Typically, the last graphitizing temperature is in the range of from about 2800° C. to about 3000° C.

The value of the longitudinal CTE of each rod was measured in the temperature range of from 30° C. to 100° C. Only longitudinal CTE is of interest herein.

Figure 2:
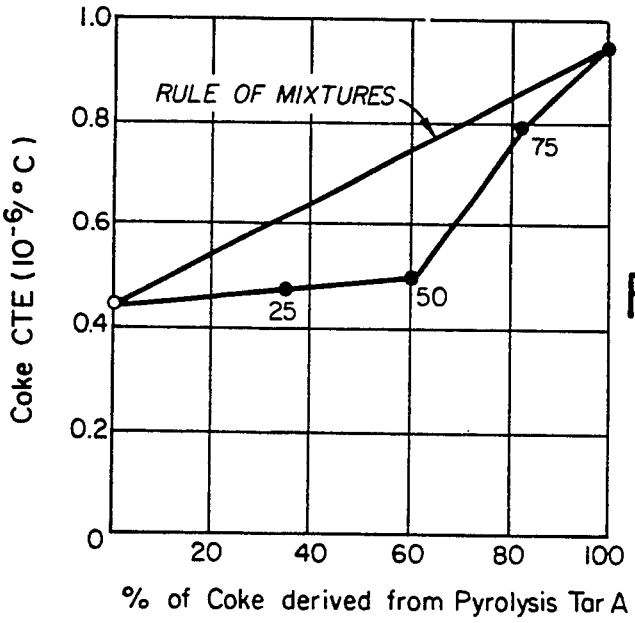
FIGS. 2 and 3 are graphs illustrating the results shown in Tables 4 and 7, respectively.

Table 4 shows the values of CTE for rods made from different blends. FIG. 2 shows graphically how the rod CTE is affected by the percentage pyrolysis tar in the feedstock blend.

TABLE 4

Pyrolysis Tar A and Hydrotreated Decant Oil A
LONGITUDINAL CTE

| Wt % Pyrolysis Tar A in Blend | CTE of Graphite Electrode per °C. × $10^{-6}$ Measured | Calculated |
|---|---|---|
| 0 | 0.44 | |
| 25 | 0.47 | 0.60 |
| 50 | 0.49 | 0.73 |
| 75 | 0.79 | 0.92 |
| 100 | 0.94 | |

It is surprising that as much as about 50% pyrolysis tar A in the blend will still provide a graphite electrode having an excellent CTE. The CTE of the rods made from the 50:50 blend of pyrolysis tar A and hydrotreated decant oil A was $0.24\times10^{-6}$/°C. less than that indicated by the rule of mixtures, as is evident from FIG. 2.

The hydrotreated decant oil modifies the pyrolysis tar to allow good continuous delayed coking and to provide excellent values of the CTE for high proportions of pyrolysis tar.

The amount of hydrotreatment given to the decant oil will have an effect on the process. If the decant oil is saturated, then it will not act as a donor. The lower limit for hydrotreating the decant oil for various blends can be determined experimentally.

The Example 1 shows that high coke yields are obtained for relatively low amounts of hydrogen. It is also advantageous economically to hydrotreat the decant oil rather than the pyrolysis tar.

EXAMPLE 2

The tests carried out in the Example 1 were carried out with the hydrotreated decant oil A of Example 1, and a predominantly kerosene-based pyrolysis tar B, having properties as shown in Table 5.

TABLE 5

| PYROLYSIS TAR B | |
|---|---|
| Specific Gravity | 1.0835 |
| ASTM Distillation | |
| IBP | 171° C. |
| 5% | 238 |
| 10% | 249 |
| 20% | 268 |

TABLE 5-continued

| PYROLYSIS TAR B | |
|---|---|
| 30% | 288 |
| 40% | 321 |
| 50% | 371 |
| 60% | 410 |
| 70% | 441 |
| 80% | — |
| 90% | — |
| 95% | 0 |
| % Recovery | 70 |
| Molecular Weight | 398 |
| Carbon, wt. % | 90.97 |
| Hydrogen, wt. % | 7.62 |
| Nitrogen, wt. % | 0.66 |
| Ash, wt. % | 0.01 |
| Metals, ppm | 0.1 |
| Sulfur, wt. % | 0.50 |
| Modified Conradson Carbon, wt. % | 16 |
| Aromaticity, | |
| Proton NMR | 42.9 |
| $^{13}C$ NMR | — |
| Pour Point | 3° C. |
| Flash Point (Open Cup) | 77° C. |
| Bromine No. | 17.98 |
| Viscosity, centistokes | |
| 38° C. (100° F.) | 1154 |
| 99° C. (210° F.) | 27 |
| TGA Pitch Fraction (550° C.+) | 30.1 |
| Toluene Insoluble, wt. % | 0.1 |
| Heptane Insoluble, wt. % | 19.2 |

Figure 3:
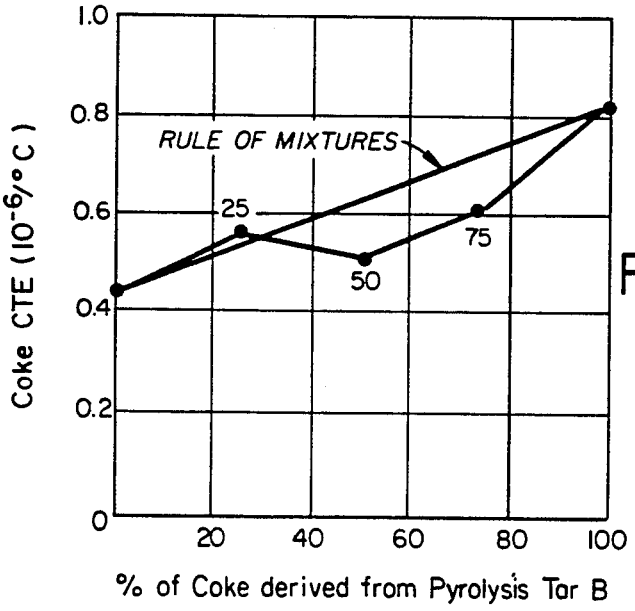

Table 6 shows the yields for the different blends and Table 7 shows the values of longitudinal CTE measured for graphite electrodes made from cokes derived from the blends. The measured CTE's of the graphite electrodes made from blends derived from 50% and 75% pyrolysis tar were more than $0.1\times10^{-6}$/°C. lower than one would calculate based on the mixtures of the two components, as is clearly evident from FIG. 3.

TABLE 6

Pyrolysis Tar B and Hydrotreated Decant Oil A
Coking Yields

| Wt. % Pyrolysis Tar in Blend | Feed Rate g/min | Yields Wt. % 500° C. Coke | 1000° C. Coke | Distillate | Cracking gas |
|---|---|---|---|---|---|
| 0 | 24 | 27 | 25.5 | 64.5 | 8.5 |
| 25 | 21 | 27.5 | 26 | 64.5 | 8 |
| 50 | 20 | 27.5 | 26 | 66 | 6.5 |
| 75 | 22 | 29 | 27 | 65 | 6 |
| 100 | 23 | 29 | 27 | 63 | 8 |

TABLE 7

Pyrolysis Tar B and Hydrotreated Decant Oil A
LONGITUDINAL CTE

| Wt. % Pyrolysis Tar B in Blend | CTE Graphite Electrode per °C. × $10^{-6}$ Measured | Calculated |
|---|---|---|
| 0 | 0.44 | |
| 25 | 0.55 | 0.54 |
| 50 | 0.50 | 0.64 |
| 75 | 0.60 | 0.73 |
| 100 | 0.82 | |

EXAMPLE 3

The hydrotreated decant oil A of the Example 1 and the pyrolysis tar B of the Example 2 were blended to run tests with the pyrolysis tar content 0%, 50%, 75%, and 100%.

Figure 4:
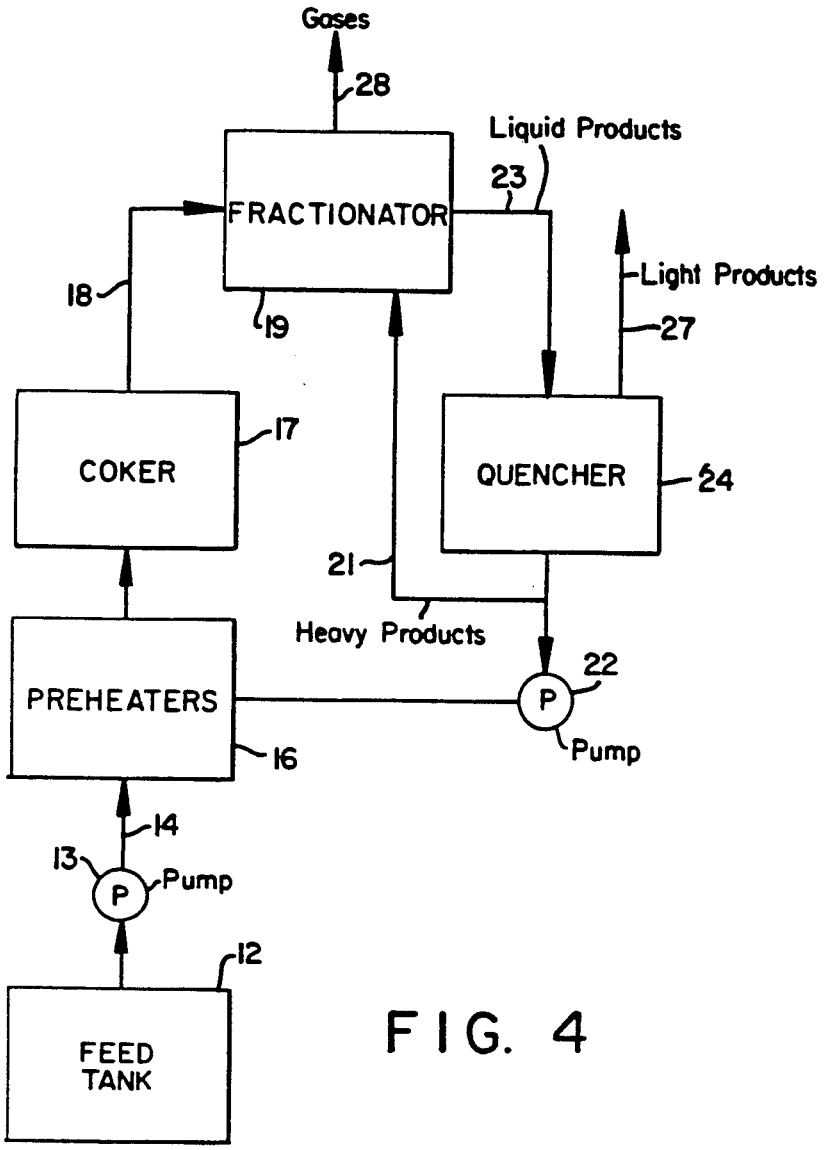
FIG. 4 is a simplified block system of a pilot plant delayed coker.
Figure 5:
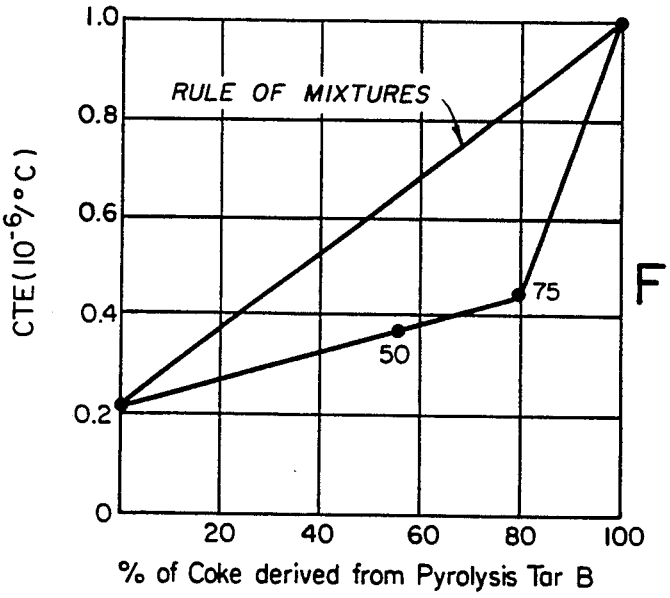

The pilot plant delayed coker shown in FIG. 4 was used. The operation of the pilot plant delayed coker is as follows:

Feed tank 12 supplies the blend to be coked. Pump 13 moves the blend from the feed tank 12 through line 14 to preheaters 16 and then to the delayed coker 17. Distillates and cracking gases from the coker 17 move through line 18 to fractionator 19. Heavy products suitable for recycling are pumped from the fractionator 19 through line 21 by pump 22 to the preheater 16. Light products from the fractionator 19 move through line 23 to quencher 24 where they are cooled. The light products in the quencher 24 which are suitable for recycling are pumped by the pump 22 through line 26 to the preheater 16. The light products in the quencher 24 not suitable for recycling are removed through line 27. Gases in the fractionator 19 are removed through line 28.

Table 8 shows some of the operating parameters of the pilot plant delayed coker. A pressure of about 275 kPa was maintained, the throughput ratio was held as close to 2.0 as possible, and the furnace temperature was in the range of from about 470° C. to about 500° C. The higher temperature was used for less reactive feedstocks whereas the lower temperature was used for more reactive feedstocks.

TABLE 8

Pyrolysis Tar B and Hydrotreated Decant Oil A Pilot Plant Coking Yields

| Wt. % Pyrolysis Tar in Blend | Feed Rate /min. | Through-put Ratio | Yields, Wt. % Coke as made | 1000° C. Coke | Distil-late | Crack-ing gas |
|---|---|---|---|---|---|---|
| 0 | 83 | 2.1 | 24 | 22.5 | 72 | 4 |
| 50 | 144 | 1.9 | 21 | 19.5 | 75 | 4 |
| 75 | 106 | 2.0 | 28.5 | 26.5 | 68.5 | 4 |
| 100 | 98 | 3.1 | 38 | 35 | 58 | 4 |

The coke yields increased and the distillate yields decreased for higher proportions of the pyrolysis tar B in the blends. The yield of coke for 100% pyrolysis tar B was higher than one would anticipate from the other results because for this test the throughput ratio was much higher than the throughput ratio used for the other tests.

Graphite electrodes were made from the cokes calcined at 1000° C. and the value of the CTE of each was measured, as in Example 1. The measured values are shown in Table 9 and FIG. 5. The CTE's of cokes made from blends containing 50–75% pyrolysis tar were $0.3–0.4\times10^{-6}$/°C. lower than those which would be expected based on the rule of mixtures. These results show that good premium coke can be made from the blend containing 75% pyrolysis tar, a result which would not have been expected based on proportional contributions by the two feedstock components.

Coking tests in this example showed another advantage of coking pyrolysis tar/hydrotreated decant oil blends. The coking runs at 40 psig with the pure pyrolysis tar caused plugging of the coker heater coils and furnace inlet tube due to the reactive nature of the feedstock. When hydrotreated decant oil was blended with pyrolysis tar, this tendency to plug the coils and inlet tube was eliminated.

TABLE 9

Pyrolysis Tar B and Hydrotreated Decant Oil A LONGITUDINAL CTE

| Wt. % Pyrolysis Tar B in Blend | CTE Graphite Electrode per °C. $\times 10^{-6}$ Measured | Calculated |
|---|---|---|
| 0 | 0.21 | |
| 50 | 0.37 | 0.69 |
| 75 | 0.44 | 0.86 |
| 100 | 1.0 | |

EXAMPLE 4

Blends were prepared of a hydrotreated decant oil B having the properties shown in Table 10 and a naphtha-based pyrolysis tar C having the properties shown in Table 11.

Figure 6:
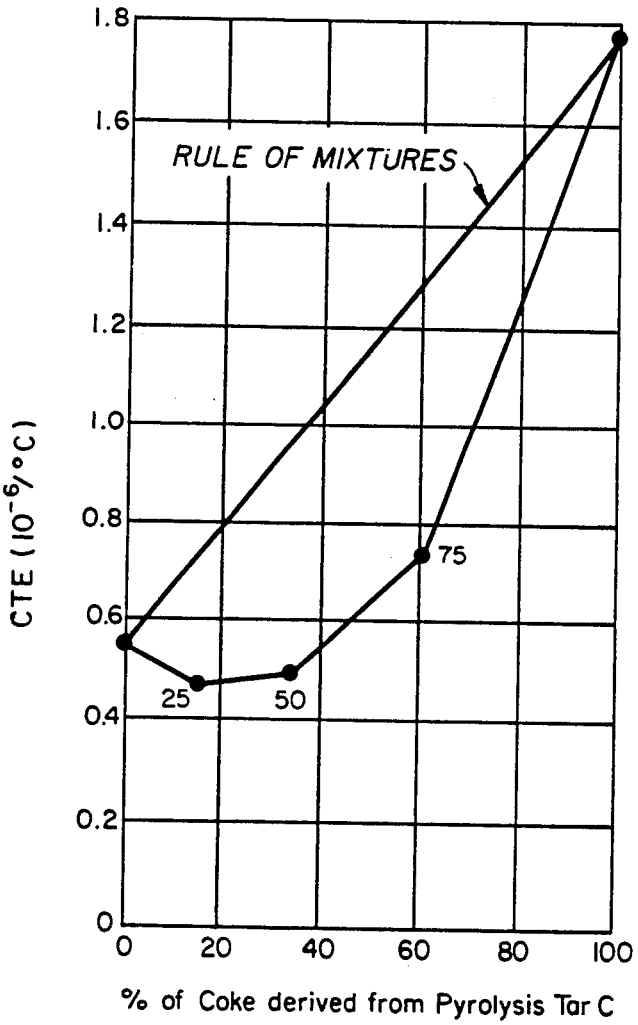

The coking was carried out as described in Example 1. Yields of coke, distillate, and cracking gas from the various blends are given in Table 12. Test graphite electrodes were prepared from the 1000° C. calcined cokes. Results in Table 13 and FIG. 6 show that the CTE's of cokes made from the blends were $0.2–0.5\times10^{-6}$/°C. less than those indicated by the rule of mixtures, indicating a very substantial synergistic effect due to blending.

TABLE 10

| HYDROTREATED DECANT OIL B | |
|---|---|
| Specific gravity | 1.04 |
| Molecular weight | 309 |
| Carbon, wt. % | 89.0 |
| Hydrogen, wt. % | 8.7 |
| Sulfur, wt. % | 0.79 |
| Modified Conradson carbon, wt. % | 1.8 |
| Aromaticity, Proton NMR % | 25 |
| Oxygen, wt. % | 0.5 |
| Added hydrogen per average molecule | 2.5 |

TABLE 11

| PYROLYSIS TAR C | |
|---|---|
| Specific gravity | 1.08 |
| Carbon, wt. % | 91.0 |
| Hydrogen, wt. % | 7.5 |
| Ash, wt. % | 0.002 |
| Sulfur, wt. % | 0.1 |
| Modified Conradson carbon, wt. % | 12 |
| Aromaticity, Proton NMR % | 52.4 |
| Toluene insoluble % | 0.1 |
| Heptane insoluble % | 0.1 |

TABLE 12

Mini-delayed Coking of Blends of Pyrolysis Tar C and Hydrotreated Decant Oil B

| Wt. of Pyrolysis Tar C in Blend | Feed Rate g/min | Yields Wt. % 500° C. Coke | 1000° C. Coke | Distillate | Cracking Gas |
|---|---|---|---|---|---|
| 0 | 22 | 42 | 39 | 43 | 15 |
| 25 | 22 | 38 | 35 | 50 | 12 |
| 50 | 25 | 30 | 28 | 62 | 8 |
| 75 | 24 | 23 | 22 | 72 | 5 |
| 100 | 26 | 21 | 20 | 76 | 3 |

TABLE 13

| Pyrolysis Tar C with Hydrotreated Decant Oil B LONGITUDINAL CTE | | |
|---|---|---|
| Wt. % Pyrolysis Tar C in Blend | CTE Graphite Electrode per °C. × $10^{-6}$ Measured | Calculated |
| 0 | 0.54 | |
| 25 | 0.47 | 0.72 |
| 50 | 0.47 | 0.96 |
| 75 | 0.74 | 1.29 |
| 100 | 1.78 | |

EXAMPLE 5

A pyrolysis tar D having the properties shown in Table 14 and hydrotreated decant oil A were blended together for coking in the pilot plant delayed coker. Blends having 0%, 50%, 75%, and 100% pyrolysis tar were used.

TABLE 1

| PYROLYSIS TAR D | |
|---|---|
| Specific Gravity | 1.1313 |
| Distillation | |
| IBP | — |
| 5% | 160° C. |
| 20% | 172 |
| 30% | 191 |
| 40% | 207 |
| 50% | 232 |
| 60% | 268 |
| 70% | — |
| 80% | — |
| 90% | — |
| 95% | — |
| EP | — |
| Recovery, % | 55.0 |
| Carbon, wt. % | 93.1 |
| Hydrogen, wt. % | 6.8 |
| Nitrogen, wt. % | 0.0 |
| Ash, wt. % | 0.02 |
| Metals, ppm | 0.1 |
| Sulfur, wt. % | 0.22 |
| Modified Conradson Carbon, wt. % | 25.1 |
| Aromaticity, | |
| Proton NMR | 48.3 |
| $^{13}C$ NMR | 84.3 |
| Pour Point | 14° C. |
| Flash Point (Open Cup) | 146° C. |
| Bromine No. | 12.88 |
| Viscosity, centistokes | |
| 38° C. | 14,456 |
| 99° C. | 80 |
| TGA Pitch Fraction (550° C.+) | 40.6 |
| Toluene Insoluble, wt. % | 4.1 |
| Heptane Insoluble, wt. % | 22.8 |

Some of the operating parameters of the pilot plant delayed coker are shown in Table 15. The coking yields increased for larger proportions of pyrolysis tar.

TABLE 15

| Pyrolysis Tar D with Hydrotreated Decant Oil A Pilot Plant Coking Yields | | | | | | |
|---|---|---|---|---|---|---|
| Wt. % Pyrolysis Tar in Blend | Feed Rate g/min. | Through-put Ratio | Yields, Wt. % Coke As Made | 1000° C. Coke | Distil-late | Crack-ing Gas |
| 0 | 83 | 2.1 | 24 | 22.5 | 72 | 4 |
| 50 | 113 | 2.0 | 34 | 31 | 54 | 7 |
| 75 | 91 | 2.0 | 36.5 | 33 | 57 | 5 |
| 100 | 60 | 2.0 | 46 | 42.5 | 48 | 6 |

Figure 7:
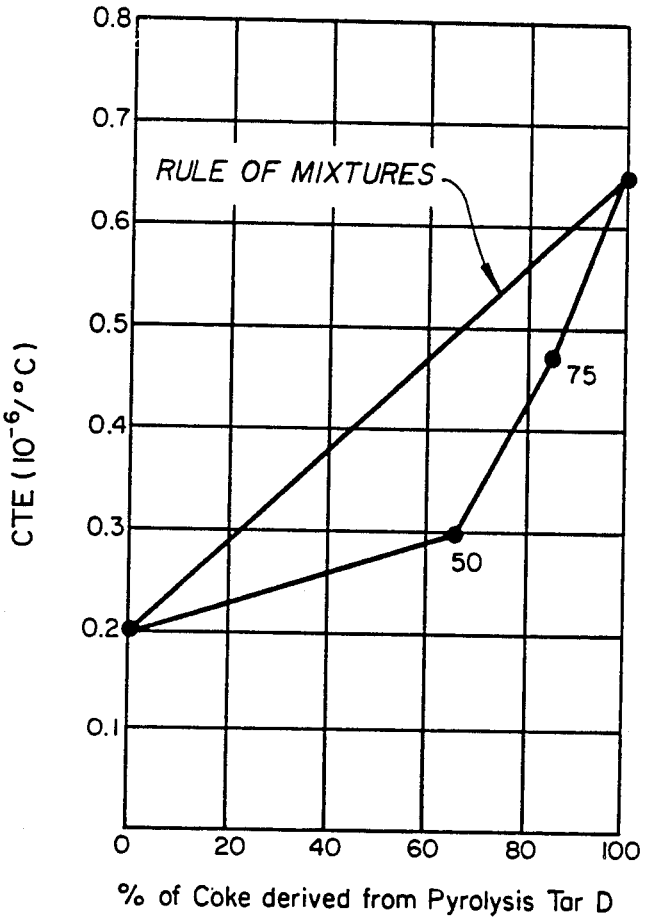

Test graphite electrodes were made and the measured values of the CTE are given in Table 16 and FIG. 7. The CTE's of cokes made from blends containing 50–75% by weight of pyrolysis tar were 0.1–0.2×$10^{-7}$/°C. less than those indicated by the rule of mixtures and were representative of premium coke quality.

TABLE 16

| Pyrolysis Tar D with Hydrotreated Decant Oil A LONGITUDINAL CTE | | |
|---|---|---|
| Wt. % Pyrolysis Tar D in Blend | CTE Graphite Electrode per °C. × $10^{-6}$ Measured | Calculated |
| 0 | 0.20 | |
| 50 | 0.30 | 0.49 |
| 75 | 0.47 | 0.58 |
| 100 | 0.65 | |

EXAMPLE 6

Blends were made with pyrolysis tar D and decant oil C, having the properties shown in Table 17 to show the results of blends which are not in accordance with the invention.

The bench scale delayed coker of the Example 1 was used for blends of 0%, 50%, 75%, and 100% pyrolysis tar. Table 18 shows some of the operating parameters. The relatively high level of sulfur for graphite electrodes made from blends containing 75% or more of decant oil would be expected to present puffing problems and would be regarded as unacceptable. This high amount of sulfur is due to the omission of the hydrotreatment which would reduce the sulfur content of the decant oil.

TABLE 17

| DECANT OIL C | |
|---|---|
| Specific Gravity, 60° F. | 1.0029 |
| Distillation | |
| IBP | 230° C. |
| 5% | 310 |
| 10% | 354 |
| 20% | 372 |
| 30% | 380 |
| 40% | 390 |
| 50% | 395 |
| 60% | 410 |
| 70% | 420 |
| 80% | 447 |
| 90% | 465 |
| 95% | 493 |
| % Recovery | 95% |
| Molecular Weight | 275 |
| Carbon, wt. % | 89.6 |
| Hydrogen, wt. % | 9.48 |
| Nitrogen, wt. % | 0.30 |
| Ash, wt. % | 0.003 |
| Metals, ppm | N/A |
| Sulfur, wt. % | 1.46 |
| Modified Conradson Carbon, wt. % | 2.0 |
| Aromaticity, | |
| Proton NMR | 17.4 |
| $^{13}C$ NMR | 57.0 |
| Pour Point | 18° C. |
| Flash Point (Open Cup) | 149° C. |
| Bromine No. | 15.4 |
| Viscosity, centistokes | |
| 38° C. (100° F.) | 51 |
| 99° C. (210° F.) | 5 |
| TGA Pitch Fraction (550° C.+) | 4.8 |
| Toluene Insoluble, wt. % | 0.0 |
| Heptane Insoluble, wt. % | 0.4 |

TABLE 18

| Pyrolysis Tar D with Decant Oil C Coking Yields | | | | | | |
|---|---|---|---|---|---|---|
| Wt. % | | Yields, Wt. % | | | | |
| Pyrolysis Tar in Blend | Feed Rate g/min | 500° C. Coke | 1000° C. Coke | Distil-late | Crack-ing Gas | % Sulfur in Coke |
| 0 | 20 | 26 | 23.5 | 62 | 12 | 1.3 |
| 25 | 18 | 29 | 26.5 | 61 | 10 | 0.9 |
| 50 | 19 | 32 | 30 | 60 | 8 | 0.65 |
| 75 | 19 | 39 | 36 | 54 | 7 | 0.35 |
| 100 | 23 | 46 | 42.5 | 48 | 6 | 0.2 |

Figure 8:
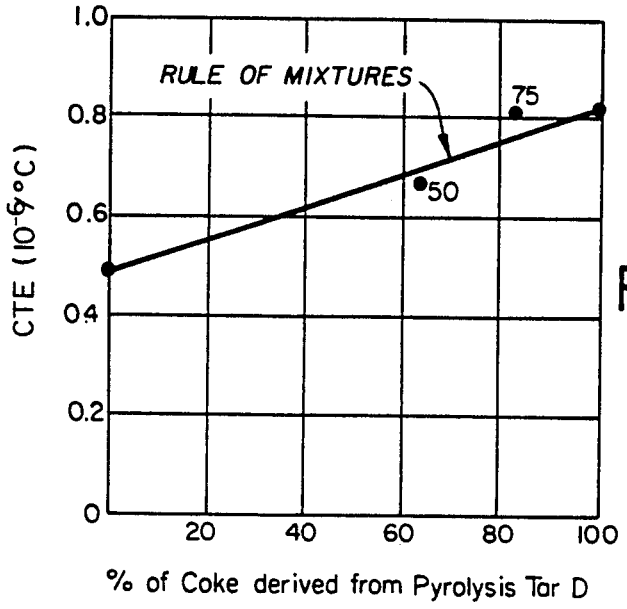

Graphite electrodes were made from the blends, except for the blend containing 25% pyrolysis tar. Table 19 and FIG. 8 show the CTE's of graphite electrodes made from cokes derived from the blends. Results in FIG. 8 show that the coke CTE's do not differ significantly from those expected from the rule of mixtures.

TABLE 19

| Pyrolysis Tar D with Decant Oil C GRAPHITE ELECTRODES NOT ACCORDING TO THE INVENTION | | |
|---|---|---|
| Wt. % of Pyrolysis Tar | Graphite Electrode CTE Per °C. $\times 10^{-6}$ | |
| D in Blend | Measured | Calculated |
| 0 | 0.49 | |
| 50 | 0.66 | 0.71 |
| 75 | 0.81 | 0.78 |
| 100 | 0.83 | |

EXAMPLE 7

The tests carried out in the Example 6 were repeated in a pilot plant delayed coker for blends containing 0%, 50%, 75%, and 100% pyrolysis tar D. In addition, the decant oil C was hydrotreated until there was added about 2.5 hydrogen atoms per average molecule of decant oil. A blend of 50% of this hydrotreated decant oil with 50% pyrolysis tar D was also coked in the pilot plant coker. Table 20 shows operating parameters and coke yields. Results for the blend containing 50% hydrotreated decant oil are shown by 50.*

TABLE 20

| Pyrolysis Tar D with Hydrotreated and Untreated Decant Oil C Pilot Plant Coking Yields | | | | | | |
|---|---|---|---|---|---|---|
| Wt. % | | Yields, Wt. % | | | | |
| Pyrolysis Tar in Blend | Feed Rate g/min | Through-put Ratio | Coke As Made | 1000° C. Coke | Distil-late | Crack-ing Gas |
| 0 | 113 | 2.5 | 31 | 29 | 59 | 9 |
| 50 | 106 | 2.0 | 35 | 32 | 60 | 5 |
| 75 | 83 | 2.0 | 37.5 | 34 | 54 | 6 |
| 100 | 60 | 2.0 | 46 | 42.5 | 48 | 6 |
| 50* | 106 | 1.8 | 27.5 | 26 | 62 | 7 |

TABLE 21

| Pyrolysis Tar D with Hydrotreated and Untreated Decant Oil C. LONGITUDINAL CTE | | |
|---|---|---|
| Wt % Pyrolysis Tar in Blend | Graphite Electrode CTE Per °C. $\times 10^{-6}$ | |
| 0 | 0.20 | |
| 50 | 0.50 | 0.53 |
| 75 | 0.65 | 0.65 |
| 100 | 0.75 | |
| 50* | 0.35 | 0.57 |

Figure 9:
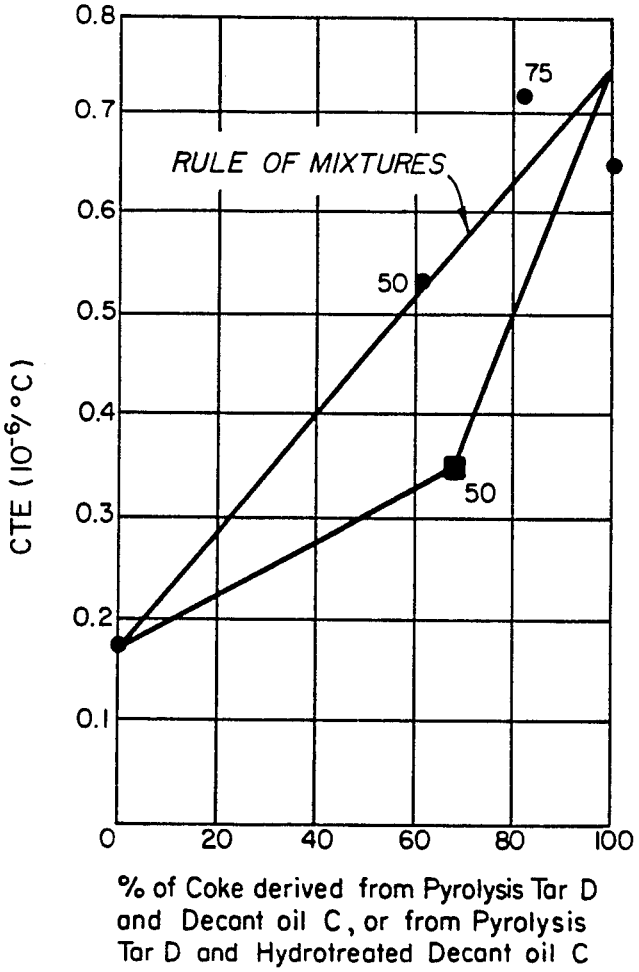

Table 21 and FIG. 9 show that cokes made from the blends containing untreated decant oil have CTE's in accordance with those calculated by the rule of mixtures, whereas coke from the blend containing 50% hydrotreated decant oil has a CTE substantially lower than that calculated from the rule of mixtures.

We wish it to be understood that we do not desire to be limited to the exact details shown and described herein, or other modifications that occur to a person skilled in the arts.

Having thus described the invention, what we claim as new and desired to be secured by Letters Patent, is as follows:

1. A process for producing a premium coke for making a graphite electrode having a CTE less than about $0.5\times10^{-6}$ per °C. comprising the steps of:

(a) providing an unhydrotreated pyrolysis tar and decant oil;

(b) hydrotreating only the decant oil until there is added from about 2 to about 4 hydrogen atoms per average molecule of the decant oil;

(c) blending the pyrolysis tar and hydrotreated decant oil together in amounts such that the blended mixture includes from about 50% to about 75% by weight of the pyrolysis tar and from about 50% to about 25% by weight of the hydrotreated decant oil; and (d) coking the blended mixture by delayed coking, whereby a premium coke is formed.

2. The process of claim 1, wherein the decant oil is hydrotreated until there is added from about 2 to about 3 hydrogen atoms per average molecule of the decant oil.

* * * * *